US007008463B2

(12) United States Patent
Furuya

(10) Patent No.: US 7,008,463 B2
(45) **Date of Patent: *Mar. 7, 2006**

(54) METHOD FOR PRODUCING AMORPHOUS METAL, METHOD AND APPARATUS FOR PRODUCING AMORPHOUS METAL FINE PARTICLES, AND AMORPHOUS METAL FINE PARTICLES

(75) Inventor: Masahiro Furuya, Tokyo (JP)

(73) Assignee: Central Research Institute of Electric Power Industry, Tokyo (JP)

( * ) Notice: Subject to any disclaimer, the term of this patent is extended or adjusted under 35 U.S.C. 154(b) by 401 days.

This patent is subject to a terminal disclaimer.

(21) Appl. No.: 10/258,326

(22) PCT Filed: Apr. 12, 2001

(86) PCT No.: PCT/JP01/03463

§ 371 (c)(1),
(2), (4) Date: Mar. 3, 2003

(87) PCT Pub. No.: WO01/81032

PCT Pub. Date: Nov. 1, 2001

(65) Prior Publication Data

US 2005/0016326 A1 Jan. 27, 2005

(30) Foreign Application Priority Data

Apr. 21, 2000 (JP) ..... 2000-121669
Sep. 22, 2000 (JP) ..... 2000-289477

(51) Int. Cl.
*C22C 45/00* (2006.01)
*B22F 9/08* (2006.01)

(52) U.S. Cl. ..... 75/338; 75/340; 148/561; 266/202

(58) Field of Classification Search ..... 75/255, 75/331, 338, 340; 266/200, 202; 148/403, 148/561
See application file for complete search history.

(56) References Cited

U.S. PATENT DOCUMENTS 4,282,034 A * 8/1981 Smith et al. ..... 75/232

(Continued)

FOREIGN PATENT DOCUMENTS

JP 57-29504 2/1982

(Continued)

*Primary Examiner*—George Wyszomierski
(74) *Attorney, Agent, or Firm*—Notaro & Michalos PC

(57) ABSTRACT

A method and apparatus are invented for producing an amorphous metal, which can readily realize amorphous metal fine particles of sub-micron order to 100 micron order including fine particles of several micrometer of a material from which an amorphous metal cannot be realized by conventional amorphous metal producing method and apparatus, with a high yield and an excellent extraction rate. A molten metal (1) is supplied into a liquid coolant (4), boiling due to spontaneous-bubble nucleation is generated, the molten metal (1) is rapidly cooled while forming fine particles thereof by utilizing a pressure wave generated by this boiling, thereby obtaining an amorphous metal. This production method is realized by apparatus comprising: material supplying means (3); a cooling section (2) which brings in the coolant (4) whose quantity is small and sufficient for cooling and solidifying the supplied molten metal (1), and rapidly cools the molten metal (1) while forming fine particles thereof by utilizing a pressure wave generated by boiling due to spontaneous-bubble nucleation, thereby obtaining amorphous fine particles; and recovery means (5) for recovering amorphous metal fine particles from the coolant (4).

20 Claims, 9 Drawing Sheets

U.S. PATENT DOCUMENTS

| | | | | | |
|---|---|---|---|---|---|
| 4,484,943 | A | * | 11/1984 | Miura et al. | 75/351 |
| 4,592,781 | A | * | 6/1986 | Cheney et al. | 75/249 |
| 4,794,977 | A | * | 1/1989 | Iversen | 164/423 |
| 5,776,264 | A | * | 7/1998 | McCandlish et al. | 148/237 |
| 6,699,305 | B1 | * | 3/2004 | Myrick | 75/351 |
| 2002/0001749 | A1 | * | 1/2002 | Hashimoto et al. | 429/218.1 |

FOREIGN PATENT DOCUMENTS

| | | |
|---|---|---|
| JP | 57-29595 | 2/1982 |
| JP | 59-89701 | 5/1984 |
| JP | 59-190304 | 10/1984 |
| JP | 62-214107 | 9/1987 |
| JP | 63-28802 | 2/1988 |
| JP | 3-24201 | 2/1991 |
| JP | 6-172819 | 6/1994 |
| JP | 8-209207 | 8/1996 |

* cited by examiner

METHOD FOR PRODUCING AMORPHOUS METAL, METHOD AND APPARATUS FOR PRODUCING AMORPHOUS METAL FINE PARTICLES, AND AMORPHOUS METAL FINE PARTICLES

TECHNICAL FIELD

The present invention relates to a method for producing an amorphous metal, and a method and an apparatus for producing amorphous metal fine particles. In particular, the present invention relates to a method for producing an amorphous metal, and a method and an apparatus for producing amorphous metal fine particles using a liquid such as water as a coolant. Further, the present invention relates to amorphous metal fine particles produced by the above-described production method.

BACKGROUND

As a conventional method for producing an amorphous metal, the melt quenching method is available. This method cools and solidifies a molten metal, which has been turned into liquid form by fusion, at a speed of $10^4$ to $10^5$ K/s, to produce an amorphous metal by injecting the metal into a coolant. Furthermore, as melt quenching methods, various methods are available, such as the gas atomizing method, the single-roll method, and the twin-roll method or the like, however the centrifugation method which uses a liquid, e.g., water, as the coolant is popularly known as a method which can relatively increase the cooling rate.

In the centrifugation method shown in FIG. 14, cooling water 101 is used as the coolant. Cooling is carried out by continuously injecting molten metal 103 with great force into a flow of the cooling water 101 which circulates in a rotary drum 102 at a high speed.

Immediately after the injection of the molten metal 103 into the cooling water 101, a vapor film is formed around the molten metal which slows down the cooling of the molten metal 103. Therefore, by injecting the molten metal 103 into the cooling water 101 with great force and supplying the cooling water 101 in a way so as to realize high-speed flow, the vapor film is made to forcibly collapse by causing a difference in speed between them. Furthermore, the cooling water 101 and the molten metal 103 are directly brought into contact with each other to realize ordinary cooling by boiling heat transfer (narrow definition of nucleate boiling which occurs on the surface of the molten metal) or convection cooling, thereby increasing the cooling rate. The ordinary cooling by boiling heat transfer or convective cooling decreases cooling efficiency when the relative rate of the coolant is not high, and hence the cooling water 101 is caused to flow with respect to the molten metal 103 at a rate of, e.g., 3 to 12 m/s.

However, since the heat flux between the two liquids, i.e., the molten metal and the coolant is restricted to the critical heat flux at the maximum level in case of the heat transfer caused due to the ordinary cooling by boiling heat transfer or convective cooling, the cooling rate cannot be significantly increased in principle. Therefore, the limit of the cooling rate is $10^4$ to $10^5$ K/s, and the composition of metals which can be converted into amorphous metals is also restricted.

It is an objective of the present invention to realize a method and apparatus for producing an amorphous metal by solidification of a molten metal at an extremely high cooling rate, not possible to date. Furthermore, the present invention enables easy production of amorphous metal fine particles having a size of submicrometer order to 100 $\mu$m order, and, in particular, that of several micrometer order which cannot be realized via previous methods and apparatus. Moreover, it is another objective of the present invention to provide a method and apparatus for producing amorphous metal fine particles with good yield and an excellent extraction rate.

DISCLOSURE OF INVENTION

To achieve this aim, a method for producing an amorphous metal devised in the present invention supplies a molten metal into a liquid coolant, forms a vapor film which covers the molten metal in the coolant, collapses the vapor film, directly brings the molten metal into contact with the coolant, causes boiling by spontaneous-bubble nucleation, forms fine particles of the molten metal while tearing the molten metal by utilizing the pressure wave induced by the boiling, and cools and solidifies the molten metal. That is, by continuously producing safe and small-scale vapor explosion by controlling the quantities of the fed molten metal and the coolant to be small, the present invention realizes amorphization of the molten metal by forming fine particles thereof while rapidly cooling the molten metal. Preferably, in the amorphous production method, the molten metal molten at a temperature which causes an interface temperature with the coolant when directly brought into contact with the coolant to become not less than a spontaneous-bubble nucleation temperature and which is not more than a film boiling lower limit temperature is supplied into the coolant, a stable vapor film which covers the molten metal in the coolant is formed, and the vapor film is caused to collapse by condensation. More preferably, the molten metal is supplied dripwise into the coolant.

A vapor film is formed around the molten metal supplied into the coolant when the coolant vaporizes due to the heat transferred from the molten material. This vapor film stabilizes when the heat budget between coolant vaporization which progresses by receiving heat from the molten metal and cooling by the coolant is balanced. However, when the temperature of the molten metal is lowered, the heat budget collapses and condensation occurs (spontaneous collapse). Alternatively, collapse occurs due to external factors such as the pressure wave, a difference in the flow rate between the molten metal and the coolant, or contact with another material (forced collapse). In the case of condensation, collapse of the vapor film occurs simultaneously over the entire surface. Therefore, contact with the coolant is carried out simultaneously on the entire surface of the molten metal, and boiling due to spontaneous nucleation occurs around the particles of the molten metal.

In the case of boiling caused via spontaneous nucleation, the boiling starts from the inside of the coolant. In order to realize nucleate boiling in water coolant, the surface tension of the water/coolant must be overcome, and the vapor embryo must be generated. An initial temperature condition at that moment is the spontaneous-bubble nucleation temperature and, for example, it is 313° C. under 1 barometer pressure in the case of water. Therefore, if the interface temperature at which the vapor film collapses and the molten metal and the coolant are directly brought into contact with each other is not less than the spontaneous-bubble nucleation temperature, the vapor embryo is generated in the coolant. When the vapor embryo is generated, vaporization is enabled at 100° C. Therefore, vapor continuously gathers there, which results in explosive boiling. In addition, since vapor generation due to spontaneous-bubble nucleation is rapid and involves production of the pressure wave, the particles of the molten metal are fragmented so as to be pulled apart by the pressure wave, thereby forming fine particles. In particular, when collapse of the vapor film occurs due to condensation, the high pressure wave is uniformly incident on the entire volume of the molten metal, and hence fine particles can be efficiently formed without leaving a large lump of the metal. At the same time, since the molten metal which has been fragmented into fine particles has an increased specific surface area, cooling becomes faster. Additionally, cooling and solidification are performed through the transition of latent heat. Since the formation of fine particles of the molten metal further increases the specific surface area and increases the cooling rate, there is a positive feedback process whereby vaporization from the coolant is increased, a further pressure wave is produced, and the formation of fine particles is facilitated. At the same time, cooling is carried out very rapidly. It has been confirmed experimentally by the present inventor that the cooling rate is far greater than $10^7$ K/s which can realize amorphization of a material, not possible to date.

Furthermore, in the method developed for producing an amorphous metal, the molten metal is supplied into the coolant by a dripping action. In this case, a large part of the cubic volume of the dripped molten metal is involved in spontaneous-bubble nucleation, and efficient formation of fine particles of the metal and cooling thereof can be facilitated. In order to realize high efficiency (formation of fine particles and the realization of the desired the cooling rate), a small molten metal droplet diameter is preferable. For example, molten metal having the size of several hundreds of micrometer or, preferentially, atomized metal, is brought into contact with the coolant. In this case, the specific surface area is increased, formation of fine particles advances, and the cooling rate is exponentially increased.

Furthermore, in the method of producing an amorphous metal of the present invention, salt is added in the coolant. In this case, salt is dissolved and exists around the vapor film which covers the molten metal, and molecules of water which exist therein are relatively reduced. Therefore, condensation normally occurs irrespective of the fact that vaporization from the coolant side is hardly generated due to ionic interface, and hence it can be considered that condensation is produced as a whole. Thus, even if the molten metal is a material for which spontaneous collapse of the vapor film hardly occurs, e.g., aluminium, with this method collapse of the vapor film is facilitated, and boiling caused through spontaneous nucleation can be accelerated. Furthermore, in case of a material whose fusion point is high and whose initial temperature is high, it takes time for the vapor film condensation to start and spontaneous collapse of the vapor film hardly occurs. In this case, however, salt in the coolant facilitates collapse of the vapor film, thereby accelerating boiling caused through spontaneous nucleation.

Moreover, in the method for producing an amorphous metal devised in the present invention, it is preferable to supply the molten metal and the coolant in the same direction and with a small difference in flow rate, and mix them. In addition, it is preferable to realize coolant flow such that the coolant flows mostly in the vertical direction and supply the molten metal in the fall area of the flow of the coolant by free drop or jet injection. In this case, the molten metal is supplied into a flow of the coolant without greatly changing the direction thereof, and the molten metal is not subjected to a large shear stress from the flow of the coolant. Therefore, vapor collapse due to external factors can be prevented and spontaneous collapse due to condensation can be achieved. Also, boiling caused by spontaneous-bubble nucleation can be simultaneously realized around the particles. Here, in regard to violent boiling, i.e., boiling caused by spontaneous-bubble nucleation, when the hot molten metal and the cold coolant are brought into mutual contact and the interface temperature becomes not less than the spontaneous-bubble nucleation temperature, these become the initiation conditions and the vapor embryo is generated. Also, when the difference in relative flow rate between the molten metal and the coolant is sufficiently low, vapor embryo grows and causes violent boiling, i.e., boiling due to spontaneous-bubble nucleation. When the flow rate of the coolant relative to that of the molten metal (relative rate) is too high, boiling due to spontaneous nucleation does not occur, or even if such boiling occurs to a small extent, cooling occurs and the boiling ceases. Thus, it is preferable to match the flow rate of the molten metal with the flow rate of the coolant. For example, the difference in the flow rate between the coolant and the molten metal should be not more than 1 m/s, or preferably, this difference should be close to zero. In this case, the shear stress acting on the molten metal from the flow of the coolant can be further suppressed.

Furthermore, in the method for producing an amorphous metal according to the present invention an ultrasonic wave is irradiated before the molten metal comes into contact with the coolant. In this case, since the molten metal can be supplied into the coolant as fine particles to some extent, the specific surface area of the molten metal can be increased and formation of fine particles via vapor explosion can be further facilitated as a whole. Also, the cooling rate can be further improved.

Moreover, the molten metal may be possibly oxidized when it is brought into contact with air before being supplied into the coolant. This oxidation changes the property of the metal, and the oxide film is not uniformly formed. Therefore, formation of fine particles/cooling does not simultaneously occur at the part having an attached oxide film and the part without such an oxide film. Thus, the vapor explosion cannot be satisfactorily utilized, and the efficiency of formation of fine particles is decreased. Consequently, the method for producing an amorphous metal devised in the present invention supplies the molten metal into the coolant while preventing oxidation of the molten metal.

Further, the method for producing an amorphous metal according to the present invention may cause a vapor film which covers a molten metal to collapse by ultrasonic irradiatioin. That is, it is possible to collapse the vapor film which covers a periphery of each droplet of the molten metal in the coolant on an early stage, directly bring the droplets of the molten metal into contact with the coolant in a high-temperature state, and cause boiling due to efficient spontaneous-bubble nucleation.

Additionally, the method for producing amorphous metal fine particles according to the present invention produces amorphous metal fine particles by using the above-described production method.

Moreover, the amorphous metal fine particles according to the present invention are produced by using the above-described production method.

Furthermore, the apparatus for producing an amorphous metal according to the present invention comprises: material supplying means for supplying the molten metal while controlling the supply quantity thereof; a cooling section which introduces a small quantity of coolant which is sufficient for cooling and solidifying the molten metal, mixes the coolant with a small quantity of the molten metal fed from the material supplying means to form a vapor film which covers the molten metal, collapses the vapor film, directly brings the molten metal into contact with the coolant, causes boiling due to spontaneous nucleation, and rapidly cools and realizes amorphization of the molten metal while forming fine particles of the molten metal by utilizing the pressure wave generated by the boiling due to spontaneous nucleation; and a recovery means for recovering fine particles of the amorphous metal from the coolant.

In case of this apparatus, by allowing free fall of the molten metal, fine particles of the molten metal are formed and rapidly cooled by boiling through spontaneous-bubble nucleation in the coolant, thereby producing the amorphous metal. Furthermore, the fine particles of the solidified amorphous metal can be collected solely by separating them from the coolant. Therefore, an atomizing nozzle having a complicated structure, a drive mechanism for rotating a rotary drum at a high speed or a power portion attached to these parts is not necessary. The equipment cost can be suppressed, excellent durability can be realized, and the possibility of failure is low.

Here, when boiling caused through spontaneous nucleation is determined to have a scale which allows the pressure wave to form fine particles of the molten metal dropped into the coolant by setting quantities of the molten metal to be fed and the coolant to be small, the pressure wave generated by boiling due to spontaneous-bubble nucleation can be prevented from becoming larger than the required amount, thereby avoiding generation of the large-scale vapor explosion. Furthermore, by setting the quantity of the coolant remaining in the cooling section to a quantity which does not allow the large-scale vapor explosion even if the molten metal is supplied all at once due to loss of control in the material supplying means, large-scale vapor explosion which leads to a disaster does not occur even if a large quantity of the molten metal flows out when the material supplying means breaks down.

Moreover, in the apparatus for producing the amorphous metal according to the present invention, the material supplying means introduces the molten metal into the coolant dropwise. Therefore, almost the entire volume of the dropped molten metal is involved with the spontaneous-bubble nucleation, thereby facilitating both, the formation of fine particles from the molten metal droplet and cooling of the molten metal.

In addition, in the apparatus for producing the amorphous metal according to the present invention, salt is added to the coolant used therein. In this case, even in case of a material which hardly realizes spontaneous vapor film collapse such as aluminium which has been considered not to cause vapor explosion, collapse of the vapor film is facilitated, and boiling due to spontaneous-bubble nucleation can be generated. Therefore, such materials which are difficult to form into fine particles, e.g., aluminum, can be fragmented into amorphous materials.

Additionally, the apparatus for producing an amorphous metal devised in the present invention causes the coolant to flow in the vertical direction in free space, and a cooling section constitutes so as to supply the molten metal in the fall area of the flow of the coolant by free fall. In this case, since spontaneous vapor film collapse can be invoked without subjecting the molten metal to the shear stress due to the flow of the coolant, fine particles can be efficiently formed, and the cooling section itself is no longer necessary in the structure. Therefore, the cost can be reduced, and the incidence of accidents or failures can be decreased.

Furthermore, the apparatus for producing an amorphous metal devised in the present invention includes ultrasonic wave irradiating means for irradiating ultrasonic waves to the molten metal between the material supplying means and the coolant. Therefore, the molten metal droplets which have been levigated to some extent by the ultrasonic wave irradiating means as a means of fragmentation can be supplied into the coolant. Accordingly, the formation of fine particles of the molten metal in the coolant can be further facilitated, and the cooling rate can be further improved. Also, since the fragmentation technique using ultrasonic waves has already been established, primary fragmentation of the molten metal can be safely and easily realized.

Furthermore, the apparatus for producing an amorphous metal according to the present invention includes oxidation inhibiting means which prevents oxidation of the molten metal fed from the material supplying means to the cooling section. Therefore, the molten metal can be brought into contact with the coolant without causing oxidation, and boiling due to spontaneous-bubble nucleation is guaranteed to occur. Moreover, droplets of the molten metals can be prevented from scattering around the cooling section.

Additionally, the apparatus for producing an amorphous metal according to the present invention causes the vapor film which covers the molten metal to collapse by ultrasonic irradiation. Therefore, it is possible to collapse the vapor film which covers a periphery of each droplet of the molten metal in the coolant on an early stage, directly bring the droplets of the molten metal into contact with the coolant in a high-temperature state, and cause boiling due to efficient spontaneous-bubble nucleation.

BEST MODE FOR CARRYING OUT OF THE INVENTION

The structure of the present invention will now be described in detail hereinafter based on the illustrated best mode.

Figure 1:
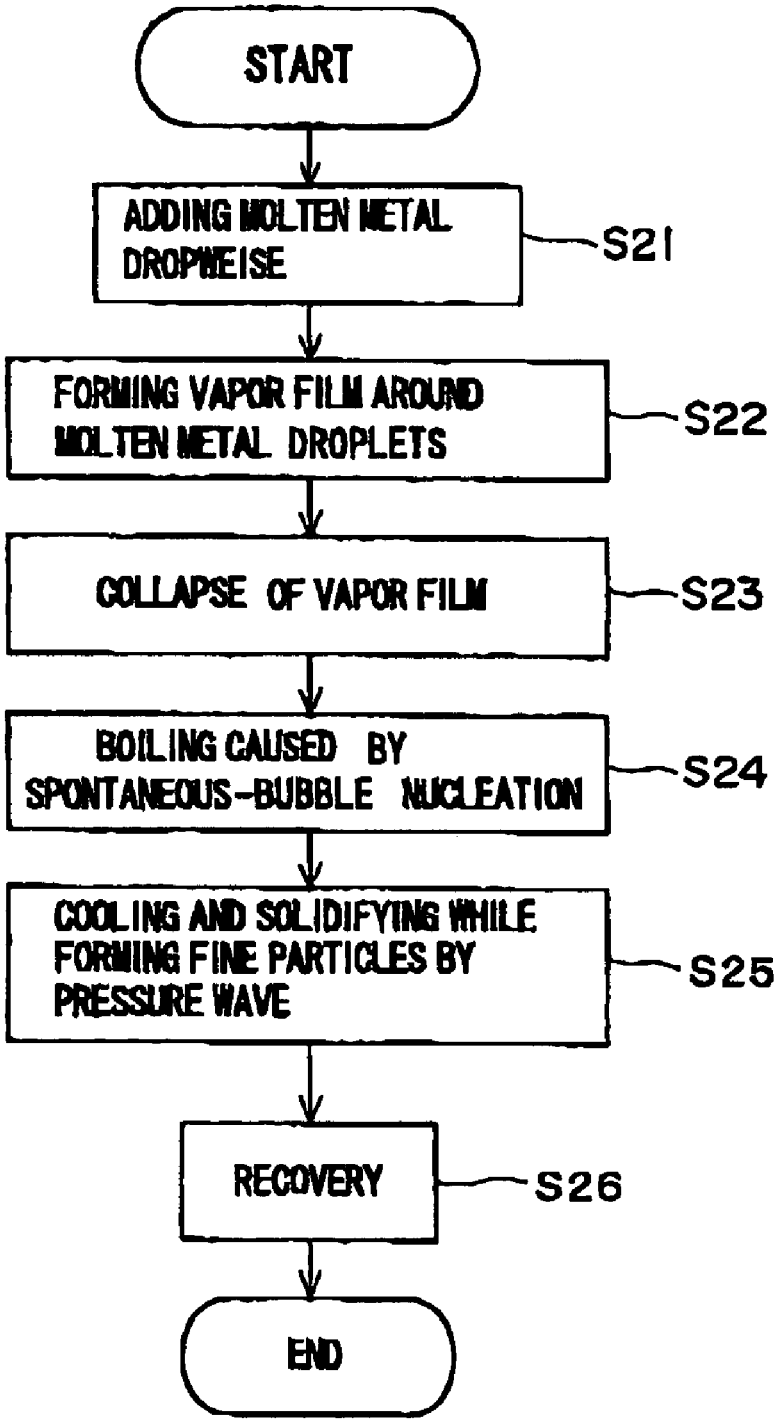
FIG. 1 is a flowchart showing the method for producing an amorphous metal according to the present invention.
Figure 2:
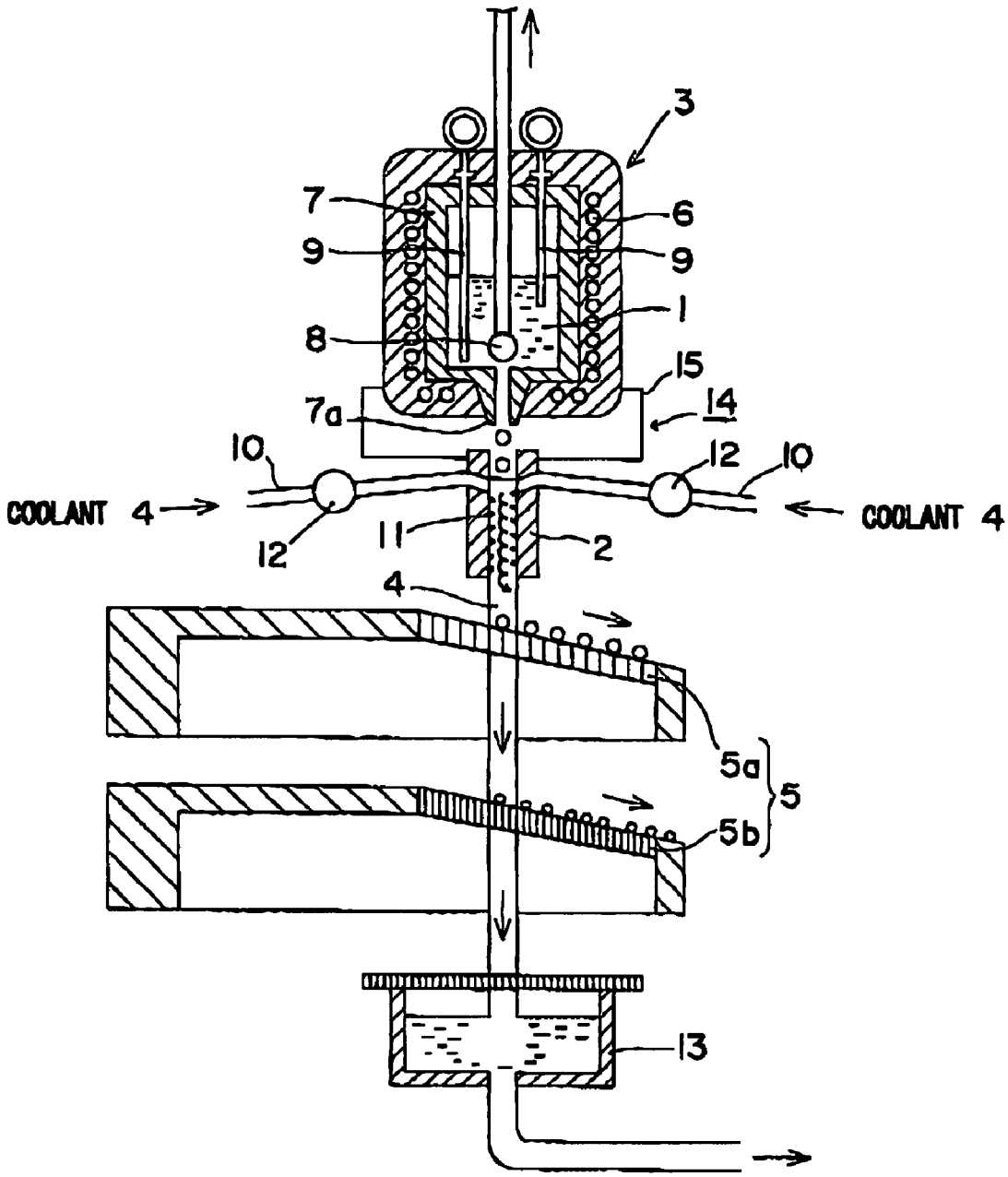
FIG. 2 is a conceptual view showing the apparatus for producing an amorphous metal according to the present invention.
Figure 3:
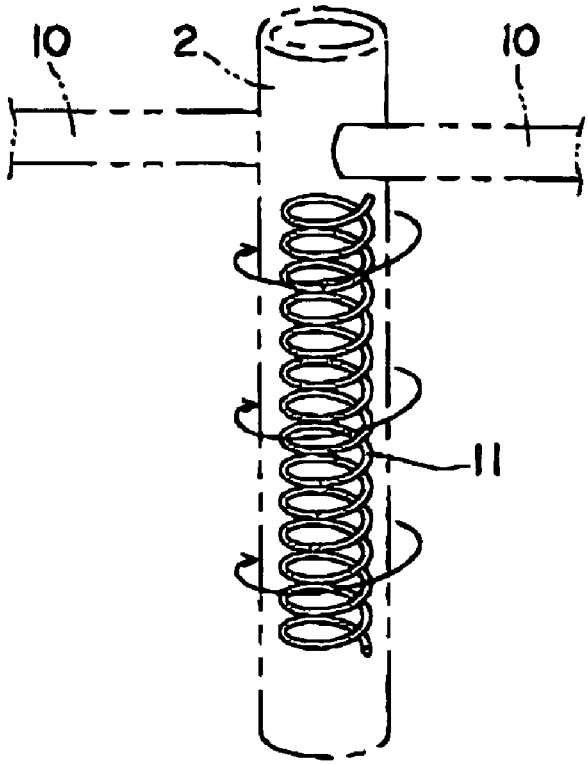
FIG. 3 is a conceptual view showing the state that a swirl flow guide wire is arranged in a mixing nozzle.
Figure 4:
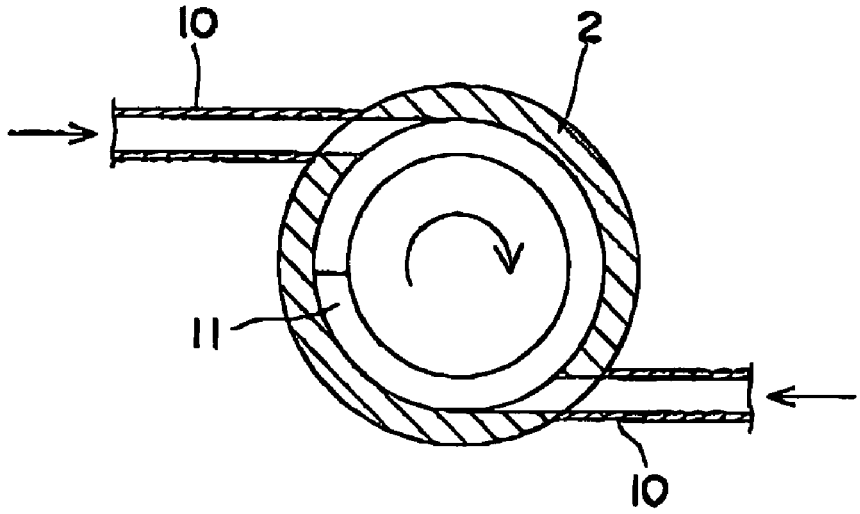
FIG. 4 is a cross-sectional view showing the connection relationship between the mixing nozzle and swirl water nozzle.

FIG. 1 shows an example of the method for producing an amorphous metal, and FIGS. 2 to 4 show an example of the apparatus for producing an amorphous metal devised in the present invention. This production apparatus includes: material supplying means 3 which supplies a molten metal 1 while controlling the supply quantity thereof; a cooling section 2 which introduces a coolant 4 which cools and solidifies the molten metal 1, mixes the coolant 4 with the molten metal 1 fed from the material supplying means 3, forms a vapor film which covers the molten metal 1, collapses the vapor film, directly brings the molten metal 1 into contact with the coolant 4, rapidly cools the mixture and realizes amorphization thereof while forming fine particles by utilizing boiling caused through spontaneous-bubble nucleation; and recovering means 5 for recovering amorphous metal fine particles from the coolant 4.

The material supplying means 3 constitutes, e.g., a crucible 7 provided with a keep-warm heater 6. This crucible 7 includes a stopper 8 which opens/closes a hot water outlet 7*a* provided on the bottom, and thermocouples 9 which measures the temperature of the molten metal 1 in the crucible 7. The stopper 8 controls the quantity of the molten metal 1 which drips from the hot water outlet 7*a* or completely stops the molten metal 1 by moving up/down by an actuator (not shown). As for the supply of the molten metal 1, it is preferable to set the quantity of the molten metal 1 as small as possible and its specific surface area large in order to increase the efficiency of fragmentation and prevent the large-scale vapor explosion which may lead to an accident. Thus, in this scenario, droplets of the molten metal are supplied in a moniliform manner one by one by free fall, each of which weights, e.g., several g. However, the present invention is not restricted to this droplet size, and it is preferable to set this droplet smaller than the droplet diameter of the liquid metal in order to obtain high fragmentation efficiency. For example, molten metal droplets having the size of several hundreds of micrometer, or more preferably, those of atomized molten metal are brought into contact with the coolant.

The cooling section constitutes a nozzle (which will be referred to as a mixing nozzle hereinafter) 2 having the structure which mixes the molten metal 1 with the constantly cold coolant 4 and simultaneously passes the mixture. The mixing nozzle 2 is set directly under the hot water outlet 7*a* of the crucible 7 so as to receive the molten metal 1 dripping from the crucible 7. It is preferable to set the distance from the hot water outlet 7*a* of the crucible 7 to the liquid surface of the coolant 4 in the mixing nozzle 2 as short as possible. For example, it is preferable to set this distance to approximately 30 mm, not more. As a result, the collision force between the molten metal droplets and the coolant can be reduced, the molten metal droplets can be smoothly fed into the coolant, and then dropped together with the coolant without causing collapse of the vapor film covering the droplets. Thus, a stable vapor film can be formed, and it can be collapsed by spontaneous collapse due to condensation all at once, thereby causing boiling due to spontaneous-bubble nucleation.

Here, with respect to the mixing nozzle 2 as the cooling section, it is required to ensure that the contact time of the molten metal 1 and the coolant 4 is sufficient for rapidly cooling at a speed required for amorphization while fragmenting the molten metal 1 by causing boiling through spontaneous-bubble nucleation (rapid vaporization phenomenon). Thus, the mixing nozzle 2 in this scenario has, e.g., a cylindrical shape, and a swirl water nozzle 10 which injects water as the coolant 4 is connected to the circumferential wall portion thereof. Two swirl water nozzles 10 are adopted and, as shown in FIG. 4, they are connected to the upper part of the mixing nozzle 2 at an interval of 180° in such a manner that they align in the tangential direction with respect to the inner peripheral surface of the mixing nozzle 2. Here, in order to provoke vapor explosion, no flow of the coolant/water is preferable. Thus, in order to increase the retention time in the mixing nozzle 2 without causing a difference in flow rate between the molten metal 1 and the coolant 4, a coil-like swirl flow guide wire 11 is provided on the inner peripheral surface of the mixing nozzle 2 so as to facilitate formation of a swirl flow by providing this guide wire from an injection opening of a swirl water nozzle 10 to an outlet at the lower end of the mixing nozzle in such a manner that the swirl flow continues to the lower part of the mixing nozzle 2 along the guide wire 11. Therefore, the water/coolant 4 injected from the two swirl water nozzles 10 forms a flow (swirl jet flow) which falls while swirling along the inner peripheral surface of the mixing nozzle 2 together with the droplets of the molten metal 1. As a result, the contact time of the molten metal and the coolant can be prolonged, and the time until the vapor film collapses due to cooling of the molten metal and the subsequent boiling owing to spontaneous-bubble nucleation (rapid vaporization phenomenon) can be assured.

A control valve 12 is provided to the piping portion in the middle of the swirl water nozzle 10, and the flow rate and the flow quantity of the swirl flow in the mixing nozzle 2 can be thus adjusted. The coolant 4 has a flow rate which does not cause the vapor film generated by mixing with the molten metal 1 to collapse, and it is adjusted so that the swirl flow can be formed so as to enable the coolant 4 to stay in the mixing nozzle 2 for a given time. Incidentally, if the flow rate of the coolant 4 is too fast, a vortex or a depressed area on the water surface of the coolant 4 is generated at the center of the mixing nozzle 2, and this prevents spontaneous collapse of the metal droplet 1. Therefore, it is desirable to set the flow rate of the coolant 4 to that which does not generate a depressed area on the water surface or a vortex, for example, not more than 1 m/s, or more preferably as low a rate as possible. Furthermore, although not shown, it is preferable to provide a cooler which cools the coolant to the supply system which circulates and supplies the coolant devised in the requirements.

As described above, by forming the swirl flow of the coolant 4 in the mixing nozzle 2, the coolant 4 can be held in the mixing nozzle 2 for a given time. Therefore, the amount of the coolant 4 to be used can be reduced, and large-scale vapor explosion does not occur.

The inside diameter of the mixing nozzle 2 is sufficiently larger than the diameter of the droplet of the molten metal 1 while small enough so that the swirl flow which slowly flows can be formed. For example, the inside diameter is approximately 2 to 8 mm or more, and approximately 25 mm or less. The quantity of the coolant 4 swirling in the mixing nozzle 2 is sufficient to fully fill the circumference of the droplet of the molten metal 1 dropped into the mixing nozzle 2. For example, the coolant 4 having a cubic volume which is at least fivefold or more than that of the metal droplet is supplied. At the same time, the amount of the coolant 4 is desired to be small such that the large-scale vapor explosion does not occur even if the crucible 7 is damaged and the molten metal 1 drops into the mixing nozzle 2 at a time. In the experiment conducted by the present inventor, it is preferable to set the amount of the coolant held in the mixing nozzle 2 at a time to approximately 100 ml or lower.

The molten metal 1 is heated by the keep-warm heater 6 to a temperature such that the interface temperature between the molten metal and the coolant becomes a spontaneous-bubble nucleation temperature or higher, or more preferably a temperature which is sufficiently higher than the spontaneous nucleation temperature when the molten metal 1 is directly brought into contact with the coolant 4. Furthermore, the temperature of the molten metal 1 is set to, e.g., a temperature at which the vapor film collapses when the molten metal 1 is directly brought into contact with the coolant 4, namely, a film boiling lower limit temperature or below. This film boiling lower limit temperature is defined by temperatures of the molten metal and the coolant when there is no external force applied.

As the coolant 4, it is possible to use any liquid which can cause boiling through spontaneous-bubble nucleation when it is brought into contact with the molten metal which should be turned into an amorphous metal. For example, water or liquid nitrogen, an organic solvent such as methanol or ethanol or any other liquid is preferable. In general, water which is superior in terms of economical efficiency and safety is used. Selection of the coolant 4 is determined in accordance with the material of the molten metal 1. For example, when the melting point of the molten metal 1 is low as with gallium, liquid nitrogen is adopted as the coolant 4. Incidentally, when the molten metal 1 is a material which hardly causes spontaneous collapse of the vapor film such as aluminium, iron or zinc, it is preferable to add salt such as sodium chloride, potassium chloride or calcium chloride to the coolant 4. For example, when zinc is used as the molten metal 1, it is possible to cause spontaneous collapse of the vapor film by using a sodium chloride solution as the coolant 4, thereby invoking vapor explosion. Moreover, when, e.g., Fe—Si based alloy is used as the molten metal 1, spontaneous collapse of the vapor film can be caused by using, e.g., 25 wt % of calcium chloride aqueous solution so that it can be saturated as the coolant 4, thereby invoking vapor explosion of the Fe—Si based alloy. In addition, when a material having a high fusion point is used as the molten metal 1, it is preferable to add salt to the coolant 4. As salt to be added in this case, it is possible to use, e.g., calcium chloride, sodium chloride, potassium sulphate, sodium sulphate or calcium nitrate. Of course, it is needless to say that it is desirable to select and use salt which does not react with to the molten metal. Additionally, as the coolant 4 containing salt, it is preferable to use seawater.

As for the addition of salt to the coolant 4, since salt dissolves and exists around the vapor film which covers the molten metal, molecules of water existing therein are relatively reduced. Therefore, ions interfere and evaporation hardly occurs from the coolant side, but condensation is usually generated. Thus, it can be considered that condensation takes place substantially. Therefore, vapor film collapse can be facilitated.

The recovery means is, e.g., a filter. In this scenario, two filters 5*a* and 5*b* are used to collect fine particles of the amorphous metal having a predetermined particle size. A filter whose mesh is coarser than the target particle size is used as the first filter 5*a*, and a filter whose mesh is finer than the target particle size is used as the second filter 5*b*. Fine particles of the amorphous metal which have passed through the first filter 5*a* and been captured by the second filter 5*b* are collected as products. Furthermore, the amorphous metal collected by the first filter 5*a* is returned to crucible 7, again melted and subjected to processing, forming fine particles.

In this production apparatus, boiling caused through the small-scale spontaneous-bubble nucleation which does not lead to an accident is provoked, fine particles of the molten metal 1 dropped into the coolant 4 are formed by utilizing the pressure wave generated through this boiling, and at the same time they are rapidly cooled to produce the amorphous metal. In this scenario, the amount of the coolant led into the mixing nozzle 2 is set as small as possible, the supply amount of the molten metal 1 is controlled to be small with the specific surface area thereof being set as large as possible, and boiling due to spontaneous-bubble nucleation is suppressed to a predetermined level by adjusting the quantities of the molten metal 1 and the coolant 4 to come into contact with each other. For example, the large-scale vapor explosion is assuredly prevented from occurring by dropping the molten metal 1 by an amount of several grams and setting the amount of the coolant 4 swirling in the mixing nozzle 2 to approximately 100 ml.

Furthermore, this production apparatus includes oxidation inhibiting means 14 which inhibits oxidation of the molten metal 1 supplied from at least the material supplying means 3 to the mixing nozzle 2. Moreover, in some cases, oxidation inhibiting means which covers the entire production apparatus including the crucible 7 with inert atmosphere is provided so that the molten metal is not oxidized when held in the crucible 7. This oxidation inhibiting means 14 utilizes, e.g., inert gas, and a casing 15, which blocks off at least the space between the hot water outlet 7*a* of the crucible 7 and the mixing nozzle 2 from the outside, is provided so that the inert gas is filled therein. It is provided in such a manner that the droplets of the molten metal fall in the inert atmosphere. As the inert gas, for example, argon or the like is used.

Fine particles of the amorphous metal can be manufactured as follows by using the apparatus having the above-described structure.

At first, a predetermined amount of the coolant 4 is supplied into the mixing nozzle 2 from the two swirl water nozzles 10, and a swirl flow which spirally falls is formed. Moreover, the molten metal 1 in the crucible 7 is heated and kept warm at a temperature such that the interface temperature of the molten metal and the coolant when the molten metal directly comes into contact with the coolant 4 becomes sufficiently higher than the spontaneous-bubble nucleation temperature.

In this state, the stopper 8 of the material supplying means 3 is moved up to cause moniliform free fall of the molten metal 1 in the crucible 7 drop by drop (step S21). The molten metal 1 is dispersed in the coolant 4 by the impetus of collision when it collides with the coolant 4 in the mixing nozzle 2, and then enters the coarse mixing state in which it is covered with the film of vapor generated by film boiling since the temperature of the molten metal is high (step S22).

The vapor film is generated around the molten metal 1 by evaporation of the coolant/water upon receiving heat from the molten metal 1. This vapor film becomes stable when the heat budget between evaporation which advances upon receiving heat from the molten metal 1 and cooling using the coolant is balanced. However, when the temperature of the molten metal is lowered, the heat budget is off-balance and condensation starts. That is, collapse of the vapor film occurs (step S23). This condensation occurs almost simultaneously on the entire surface. Therefore, the molten metal 1 comes into contact with the coolant on the entire surface almost simultaneously and their interface temperature becomes equal to or above the spontaneous-bubble nucleation temperature. Thus, boiling caused through spontaneous-bubble nucleation occurs in the coolant 4 which is the liquid with a lower temperature around the particles of the molten metal (step S24). Boiling due to spontaneous-bubble nucleation produces rapid evaporation, and causes sudden expansion of the vapor bubbles, thereby generating the high pressure wave. This pressure wave propagates at a very high speed and uniformly acts on all of the particles of the molten metal. Therefore, the particles are fragmented so as to be pulled apart by the pressure wave, thereby forming fine particles (step S25). At the same time, by the formation of the fine particles, the specific surface area becomes larger, which further increases the cooling rate. This increases evaporation from the coolant and evolves into vapor film formation, vapor film collapse and boiling due to spontaneous-bubble nucleation, thereby generating a further pressure wave.

Thus, when the vapor film is broken by any dispersed particle, the pressure wave generated spreads to other particles, which invokes boiling due to spontaneous-bubble nucleation. Furthermore, since the formation of fine particles of the molten metal increases the specific surface area and increases the cooling rate, there occurs a positive feedback phenomenon that evaporation from the coolant is increased to produce the further pressure wave, and formation of fine particles is facilitated. At the same time, rapid cooling is carried out. Therefore, the molten metal is efficiently formed into fine particles without leaving a large lump, and rapid cooling is also carried out at a rate which is far greater than $10^7$ K/s, thereby forming the amorphous metal.

Here, since the molten metal 1 is fragmented into fine particles by utilizing the pressure wave generated from bubbles of several nm size generated through spontaneous-bubble nucleation and it is rapidly cooled, it can be readily manufactured as fine particles ranging in size from submicrometer order to 100 $\mu$m order. Furthermore, it is possible to realize the production of fine particles with the size of several micrometer which cannot be realized by the conventional apparatus used for producing the amorphous metal or approximately 3 $\mu$m in particular which cannot be obtained by the method to date. Moreover, this formation of fine particles does not leave a large lump by forming fine particles of the metal as a whole at the same time, resulting in the good yield. In addition, since the particle size distribution is concentrated, a large quantity of fine particles with the desirable size can be obtained. Additionally, in this case, the efficiency of fragmentation into fine particles per unit mass (percentage of fragmentation into fine particles) can be improved. Furthermore, the specific surface area is increased when the fragmentation into fine particles proceeds, thereby increasing the cooling rate.

Furthermore, in the present production apparatus, fine particles of the molten metal are formed only under the free fall condition, e.g., dropping of the molten metal into the coolant which swirls and falls in the mixing nozzle 2, and the molten metal is rapidly cooled during its conversion into the amorphous metal. Therefore, a high pressure is not imposed on the nozzle as in the gas atomizing method which fragments into fine particles by using a molten metal emission nozzle, and the durability of the apparatus can be improved, thereby enabling long-term operation. Moreover, since the structure of the apparatus is simple, the manufacturing cost of the apparatus can be suppressed.

Incidentally, the metal fine particles which have been turned into the amorphous metal and the coolant 4 fall in the mixing nozzle 2 while swirling, and the coolant 4 is transmitted through the first filter 5*a* and the second filter 5*b* and returned into the tank 13. Then, the amorphous metal fine particles are captured by the filter 5*a* or the filter 5*b*.

In the experiment conducted by the present inventor, by continuously dropping the molten metal ($Al_{89}$—$Si_{11}$ alloy) having a temperature of approximately 1500° C. as droplets each having a diameter of approximately 8 mm into the mixing nozzle 2 which swirl 100 ml of the coolant at a flow rate of approximately 1 m/s, the molten metal is rapidly cooled and solidified at a rate far greater than $10^7$ K/s while forming fine particles.

In addition, in the above-described scenario, although the description has been given taking the cooling section constituted by the mixing nozzle 2 as an example, the present invention is not restricted thereto. For example, the cooling section 2 may constitute a flow of the coolant emitted into a free space. For example, although not shown, nozzles which emit the coolant may be aligned around the hot water outlet 7*a* of the crucible 7 and arranged in such a manner that they face vertically downwards, thereby causing the molten metal and the coolant to flow downward in the same direction. In this case, there is almost no difference in the flow rate between the molten metal and the coolant, and the shear stress which causes collapse of the vapor film does not act. Thus, spontaneous collapse of the vapor film uniformly occurs, and the efficiency of formation of fine particles is improved.

Figure 5:
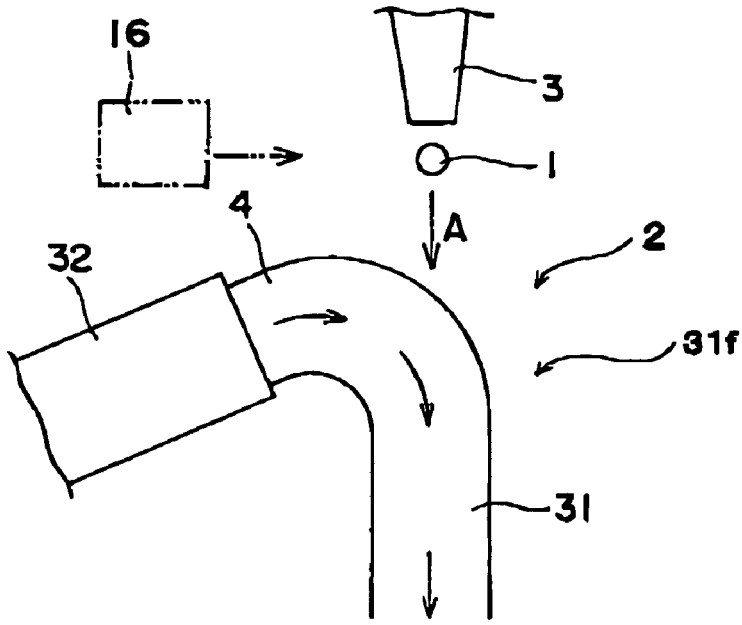
FIG. 5 is a conceptual view showing a first modification of the apparatus for producing an amorphous metal devised in the present invention.

Additionally, as shown in FIG. 5, a nozzle 32 which discharges the coolant 4 upwardly at a slant (or in the horizontal direction although not shown) may be provided, and the molten metal 1 may be dropped and supplied to the part of an area 31 in which the flow direction of the coolant 4 emitted from the nozzle 32 is changed to the downward direction by the action of gravitational force. A downward flow area 31*f* can be formed in the vicinity of the nozzle 32 by temporarily discharging the coolant 4 upwards. In this case, since the area 31*f* which is in the substantially vertical direction of the flow 31 of the coolant 4 is also vertical with respect to the supply direction A of the molten metal 1, the dropped molten metal 1 is supplied into the coolant 4 without greatly changing its flowing direction, thereby minimizing the shear stress acting on the molten metal 1 from the flow of the coolant 4. Furthermore, the shear stress acting on the molten metal 1 from the flow 31 of the coolant 4 can be further suppressed by matching the falling rate of the molten metal 1 to be confluent with the flow rate of the coolant 4. That is, although the vapor film is generated between the molten metal 1 and the coolant 4 when the molten metal 1 is introduced into the flow 31 of the coolant 4, the vapor film does not collapse by the shear stress generated by the flow 31 of the coolant 4, but the entire vapor film can collapse by condensation of the vapor film at a blast, thereby causing boiling due to spontaneous-bubble nucleation as a whole volume. In this case, the state in which there is almost no difference in the flow rate between the coolant 4 and the molten metal 1 can be realized by setting the flow rate of the coolant 4 flowing out from the nozzle 32 to, e.g., not more than 50 cm/s, or more preferably approximately 20 cm/s, thereby facilitating the coolant 4 to cause boiling due to spontaneous-bubble nucleation. Although a slower discharge rate of the coolant is preferable, when it is lower than approximately 20 cm/s, an uncluttered flow such as that shown in FIG. 5 cannot be formed since it drips from the nozzle opening. In order to constitute a so-called parallel flow system by which the downward flow area 31*f* which is in basically the same direction as the direction along which the droplets of the molten metal are jetted (falling direction) is formed in the flow 31 of the coolant by discharging the coolant from the side with respect to the supply direction of the molten metal, this can be carried out by arranging the nozzle in the horizontal or slightly downward direction instead of arranging it in the slightly upward direction as with the nozzle 32 shown in FIG. 5. In this case, the coolant can be emitted at a lower rate.

Figure 6:
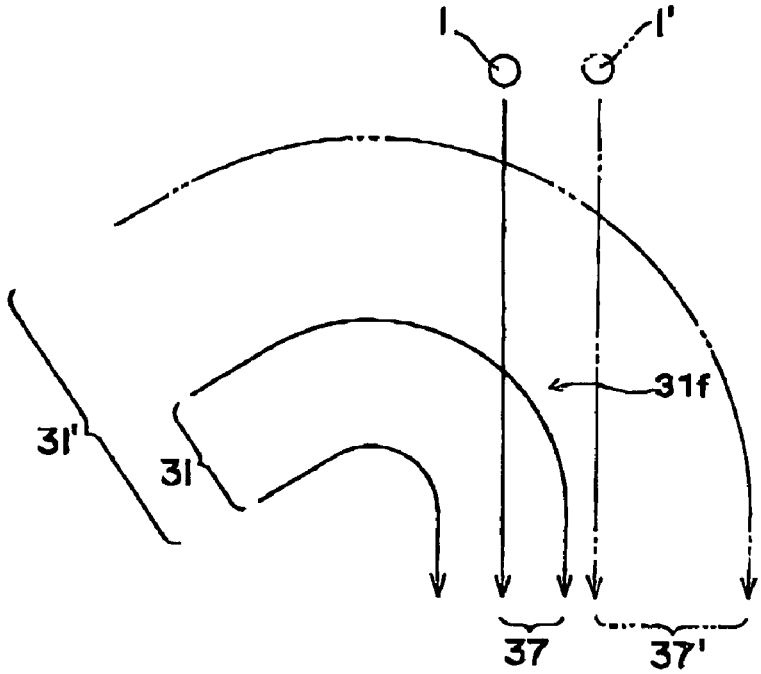
FIG. 6 is a conceptual view showing the state that the molten metal becomes confluent with a flow of the coolant.

Additionally, it is preferable to increase the thickness of the flow 31 in the downward flow area 31*f* in the flow 31 of the coolant 4 to be twofold or fivefold of the thickness of the droplet or jet of the molten metal 1 to be supplied. The thickness of the flow 31 in the downward flow area 31*f* of the coolant 4 is increased to be at least twofold of the thickness of the droplet or jet of the molten metal 1 because a sufficient amount of the coolant 4 which can cause boiling due to spontaneous-bubble nucleation can be ensured around the molten metal 1 in the coolant 4 by setting such a value. Furthermore, the thickness of the flow 31 of the coolant 4 is set to be fivefold or less than the thickness of the droplet or jet of the molten metal 1 because the shear stress acting on the molten metal 1 is increased when the thickness is set to a larger value. That is, as indicated by the solid line in FIG. 6, when the thickness of the flow 31 of the coolant 4 is small, the quantity of the transverse flow 37 is not large before the molten metal 1 flows into the flow 31. However, as indicated by the chain double-dashed line in FIG. 6, when the flow 31' of the coolant 4 becomes thick, the amount of the transverse flow 37' becomes large until the molten metal 1 flows together with the flow 31', and a larger shear stress acts. That is, by setting the thickness of the flow 31 of the coolant 4 to a value which falls within the above-described range, a sufficient quantity of the coolant 4 can be ensured around the molten metal 1, and also the shear stress received from the flow 31 of the coolant 4 can be suppressed. Incidentally, the nozzle 32 does not necessarily have to be set upwards at a slant, and may be set in the horizontal direction or downwards at a slant, for example.

Figure 7:
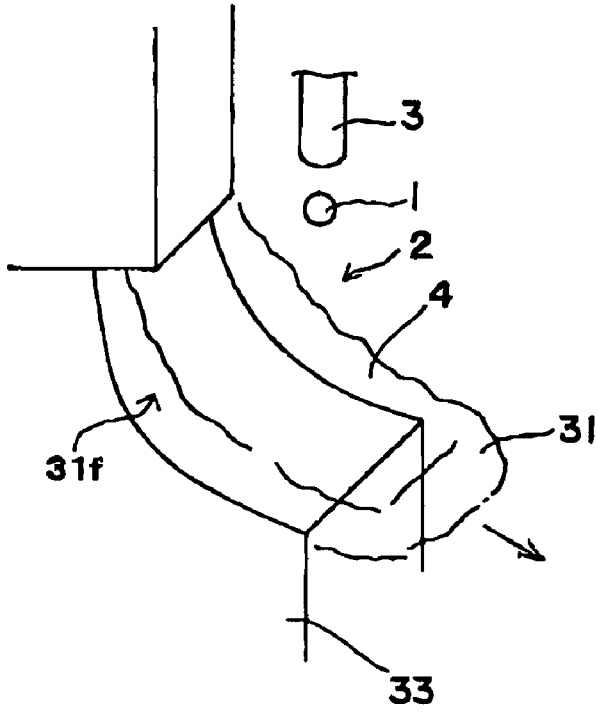
FIG. 7 is a conceptual view showing a second modification of the apparatus for producing an amorphous metal devised in the present invention.

Furthermore, as shown in FIG. 7, the flow 31 of the coolant 4 whose downward direction varies to the horizontal direction by flowing the coolant 4 on a curved guide 33 may be formed, and the molten metal 1 may be supplied to this flow 31 from the material supplying means 3. By doing so, a small amount of the coolant 4 can suffice, and a sufficient quantity of the coolant 4 can be ensured around the molten metal 1.

Figure 8:
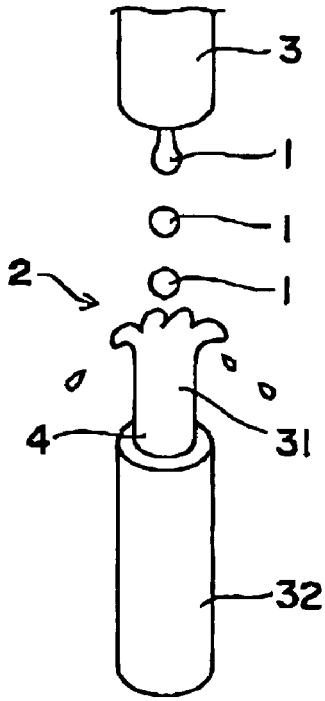
FIG. 8 is a conceptual view showing a third modification of the apparatus for producing an amorphous metal devised in the present invention.

Moreover, as shown in FIG. 8, the nozzle 32 which injects the coolant 4 may be set upwards, and the molten metal 1 may be supplied from directly above the nozzle 32. By adopting such a structure, the cooling section 2 which cools the molten metal 1 becomes simple and compact. Therefore, many nozzles 32 can be aligned and arranged in a small space, and the apparatus suitable for mass production can be realized. That is, metal fine particles can be produced on a large scale with smaller equipment investment.

Figure 9:
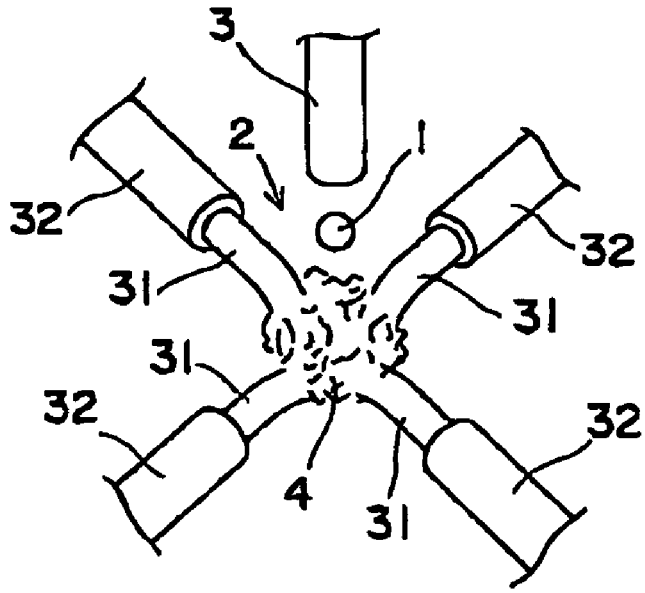
FIG. 9 is a conceptual view showing a fourth modification of the apparatus for producing an amorphous metal devised in the present invention.

In addition, as shown in FIG. 9, multiple nozzles 32 which inject the coolant 4 toward the point of fall of the molten metal 1 may be provided so as to surround this point of fall. In FIG. 9, four nozzles 32 are provided in the circumferential direction at intervals of 90 degrees. By injecting the same amount of the coolant 4 from the four nozzles 32 at the same rate and causing the coolants 4 to collide with each other, the flow 31 of the coolant 4 is canceled out, thereby forming a buildup of the coolant 4 in the cooling section 2. That is, by injecting the coolant 4 from the four nozzles 32 toward the point of fall of the molten metal 1, the buildup of the coolant 4 of a sufficient amount which can cause boiling due to spontaneous-bubble nucleation can be formed around the supplied molten metal 1, thereby realizing excellent formation of the amorphous metal of the metal fine particles and improving the fine particle yield. That is, the percentage of the fine particles each having a predetermined particle size or a smaller size can be increased, thus improving the yield of fine particle production. Incidentally, by injecting the coolant 4 from the four nozzles 32 at a flow rate of, e.g., 50 cm/s, the buildup of the coolant 4 which is suitable for causing boiling due to spontaneous-bubble nucleation can be formed.

Figure 10:
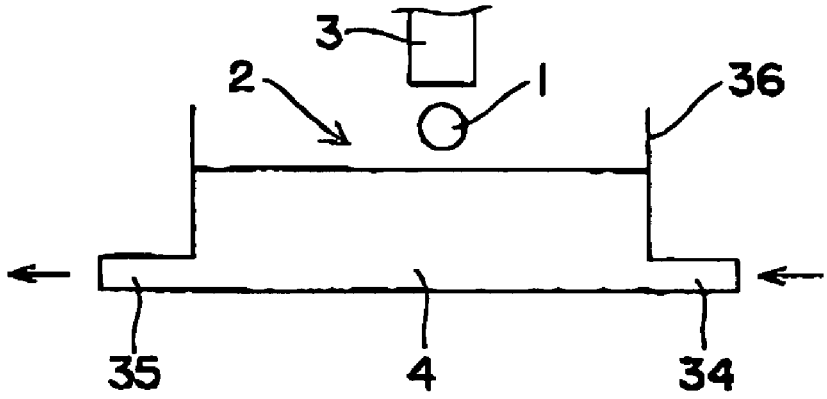
FIG. 10 is a conceptual view showing a fifth modification of the apparatus for producing an amorphous metal devised in the present invention.

Additionally, as shown in FIG. 10, the molten metal 1 can be supplied into a pool 36 in which the coolant 4 flows in from a port 34 and flows out from a port 35. In this case, by forming the circumferential wall of the pool 36 to a given height, all of the manufactured metal fine particles can be collected in the pool 36. Therefore, recovery of the amorphous metal fine particles can be facilitated.

Here, the influence of a difference in the mixing system between the coolant and the molten metal on the formation of fine particles will be described with reference to FIG. 11, and the influence of a difference in the molten metal temperature on the formation of fine particles will be explained in connection with FIG. 12.

Figure 11:
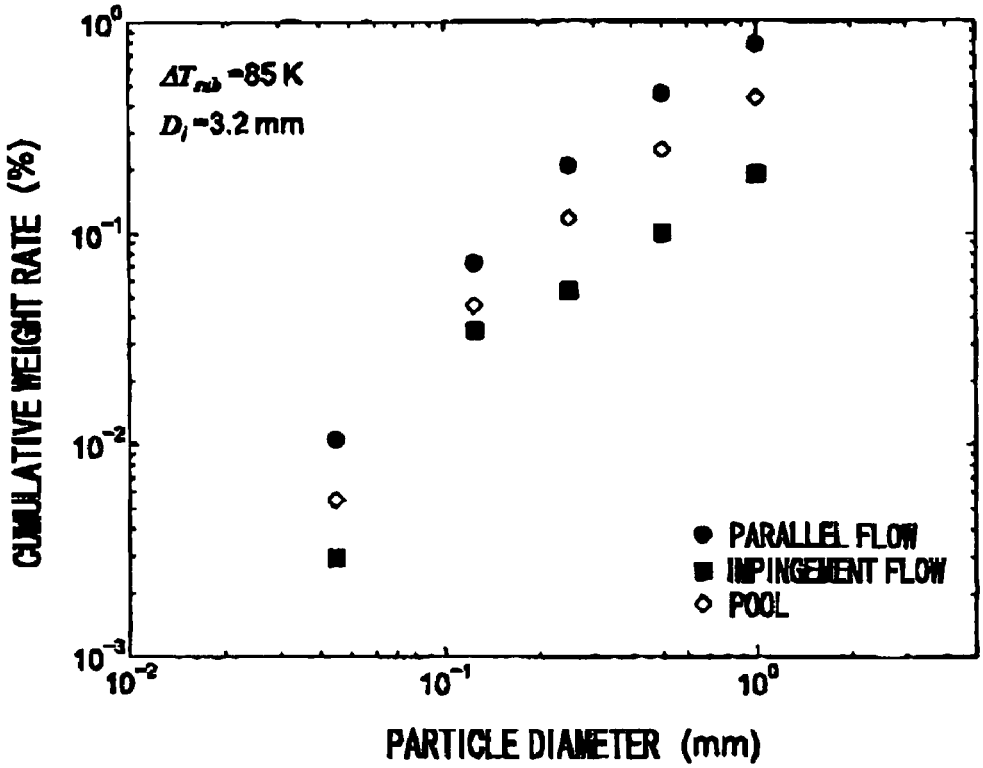
FIG. 11 is a graph showing the relationship between the method for supplying the molten metal into the coolant and particle size distribution of the molten metal levigated by this method.

FIG. 11 shows particle size distribution of the molten metal (tin) relative to three different types of contact modes of the coolant and the molten metal. Water is used as the coolant, and the parallel-flow method for supplying the water is illustrated in FIG. 5. It is a method for supplying the molten metal 1 to the flow 31 of the coolant 4 in a direction substantially equal to the supply direction of the molten metal 1 (which will be referred to as parallel flow in this specification) (reference character A). The impingement flow method is depicted in FIG. 8. It is a method for supplying the molten metal to the flow 31 of the coolant 4 which is injected upwards relative to the molten metal 1 falling from directly above (which is referred to as impingement flow in this specification) (reference character B). The pool system is illustrated in FIG. 10. It is a method for supplying the molten metal 1 to the pool 36 in which water is filled in a vertical pipe having an inside diameter of 155 mm (reference character C). The distance between the nozzle from which the molten metal 1 is dropped and the liquid surface of the coolant 4 is 30 mm in all the methods. Furthermore, the subcooling degree of the coolant 4 (initial subcooling degree in the method illustrated in FIG. 10) is determined as 85 K. Finally, the initial temperature of the molten metal (tin) 1 is determined as 700° C., and droplet diameter is determined as 3.2 mm.

Referring to FIG. 11, it was found that formation of fine particles of the molten metal 1 is maximally facilitated when the droplet of the molten metal 1 is brought into contact with the parallel flow (in case of reference character A) and the efficiency of formation of fine particles is high in the order of the method for dropping the droplet of the molten metal 1 into the pool 36 (in case of reference character C) and the method for bringing the droplet of the molten metal 1 into contact with the impingement flow (in case of reference character B). The efficiency of formation of fine particles is highest in the method using the parallel flow because of the following reason. When supplying the molten metal 1 into the parallel flow, the molten metal 1 can be made to flow together with the flow 31 of the coolant 4 without significantly changing the direction thereof. Therefore, the shear stress acting on the molten metal 1 from the flow 31 of the coolant 4 can be minimized. As a result, it can be considered that boiling due to spontaneous-bubble nucleation is most apt to be generated and stably grows and most of the droplets of the molten metal 1 can be related with vapor explosion. In addition, in case of the method of falling droplets of the molten metal 1 into the pool 36, it can be considered that the formation of fine particles of the molten metal 1 is not greatly facilitated since the substantial subcooling degree of the coolant 4 with which the following droplet comes into contact is lowered. On the other hand, as for the method for bringing the droplets of the molten metal 1 into contact with the impingement flow, it was observed that fine particles of the lower part of the droplet which can be a collision surface are formed due to vapor explosion but any other part leads to regular nucleate boiling or convection cooling, thereby complicating realization of the amorphous metal.

Figure 12:
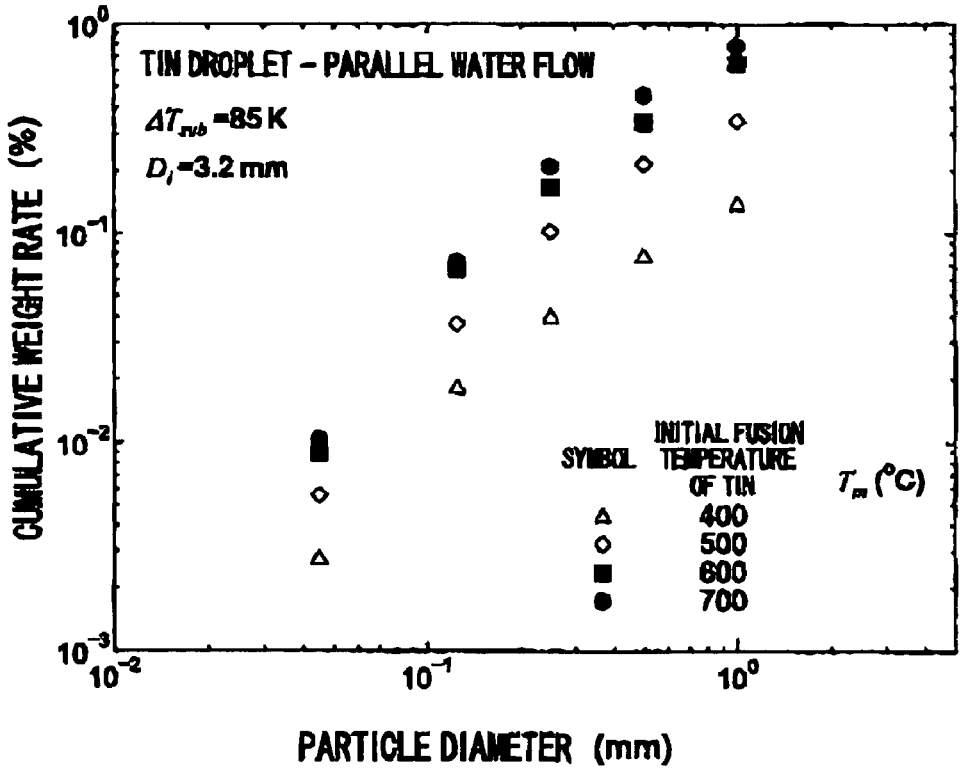
FIG. 12 is a graph showing particle size distribution of metal fine particles produced by changing the molten metal temperature.

FIG. 12 shows the particle size distribution obtained by bringing the coolant and the molten tin droplet into contact with each other by the parallel flow system having the maximal efficiency of formation of fine particles in accordance with each molten tin temperature. With increase in the initial molten tin temperature, the formation of fine particles is facilitated. It is considered that the formation of fine particles is facilitated because the pressure generated by vapor explosion becomes high when the enthalpy difference until a solidification point at the time of direct contact is large and the viscosity coefficient thereby becomes small. However, with an increase in temperature, the influence of these factors on the formation of fine particles becomes small. Additionally, since vapor explosion does not occur because the vapor film does not spontaneously collapse when a given temperature or above is reached, it can be considered that an optimum temperature exists for the formation of fine particles.

Based on these results, it became apparent that an optimum initial temperature for the formation of fine particles exists and the formation of fine particles is maximally facilitated when all of the droplets are related to vapor explosion in the contact mode in which the relative velocity with respect to the coolant is small.

Furthermore, the method for manufacturing the amorphous metal devised in the present invention was carried out by using a substance which cannot be turned into an amorphous metal ($Al_{89}$—$Si_{11}$ alloy), and the cooling rate was confirmed as follows on the basis of secondary dendrite-arm pacing at the center portion of a particle section. Here, the initial temperature of the molten metal is approximately 1000° C., droplet diameter is 6 mm, and the molten metal is caused to collide with the surface of the aqueous solution which is vertically below by 150 mm. The initial subcooling degree is determined as 85 K. It is known that spontaneous vapor explosion does not occur by the combination of aluminium and water. In the present invention, by using an aqueous solution containing 25 wt % of calcium chloride as a vapor explosion accelerator, vapor explosion of Al—Si could be produced, thereby obtaining the powder.

In order to measure the cooling rate, the Al—Si powder formed as fine particles by vapor explosion was polished and etched by using aqua regia, and dendrite was observed by a metal microscope. As an example, an average secondary dendrite arm spacing at a central part of the relatively large powder (particle diameter: 1 mm) was 0.83 $\mu$m. Based on the correlation equation relative to $Al_{89}$—$Si_{11}$, it can be assumed that the cooling rate was $2.0\times10^5$ K/s. Furthermore, although the powder having the particle diameter of several micrometer whose cooling rate is considered to be high was also observed, detail measurement was impossible by the metal microscope since the secondary dendrite arm spacing was small.

Figure 13:
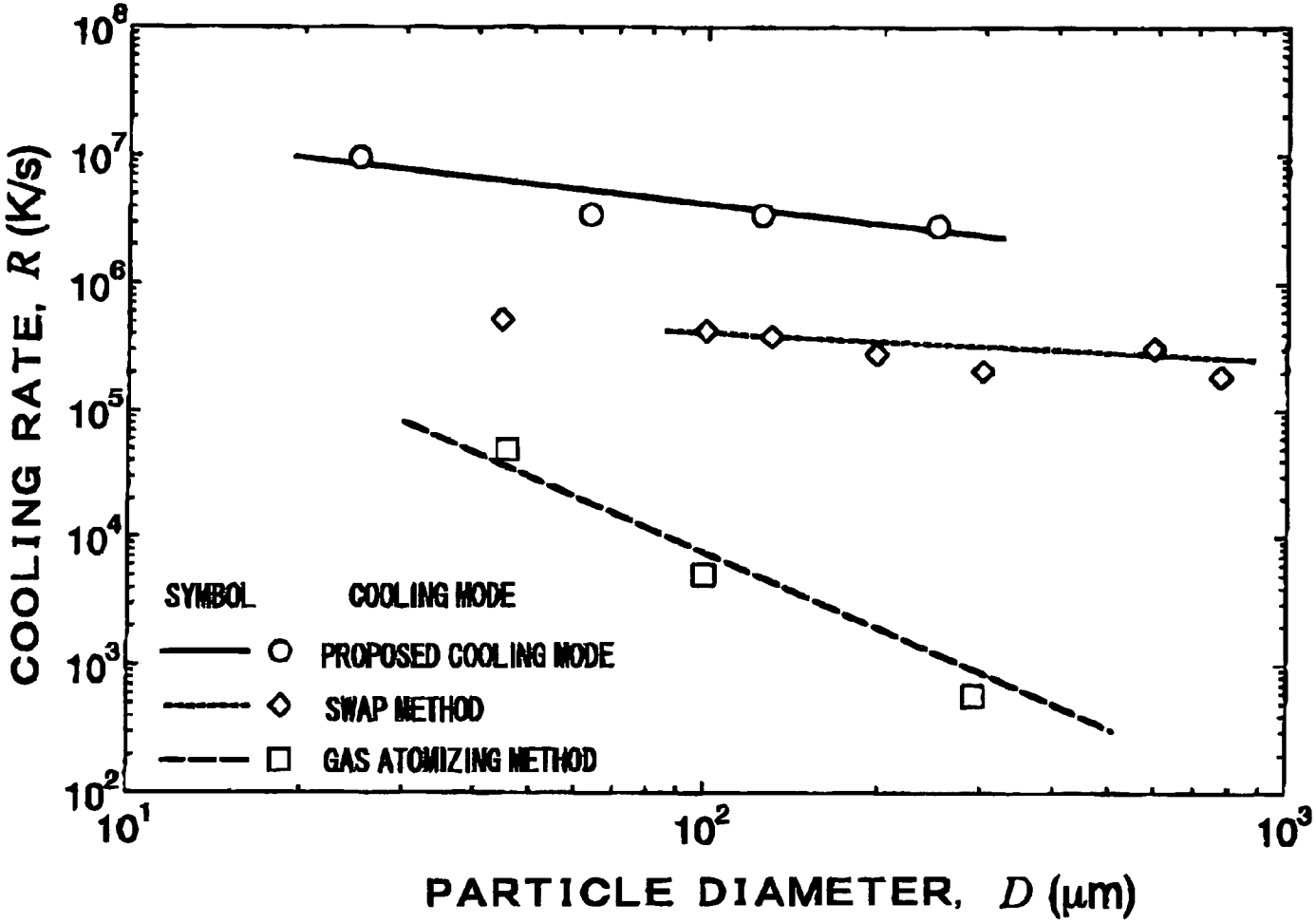
FIG. 13 is a graph comparing the cooling rate of the cooling method devised in the present invention with the cooling rate of conventional cooling method.
Figure 14:
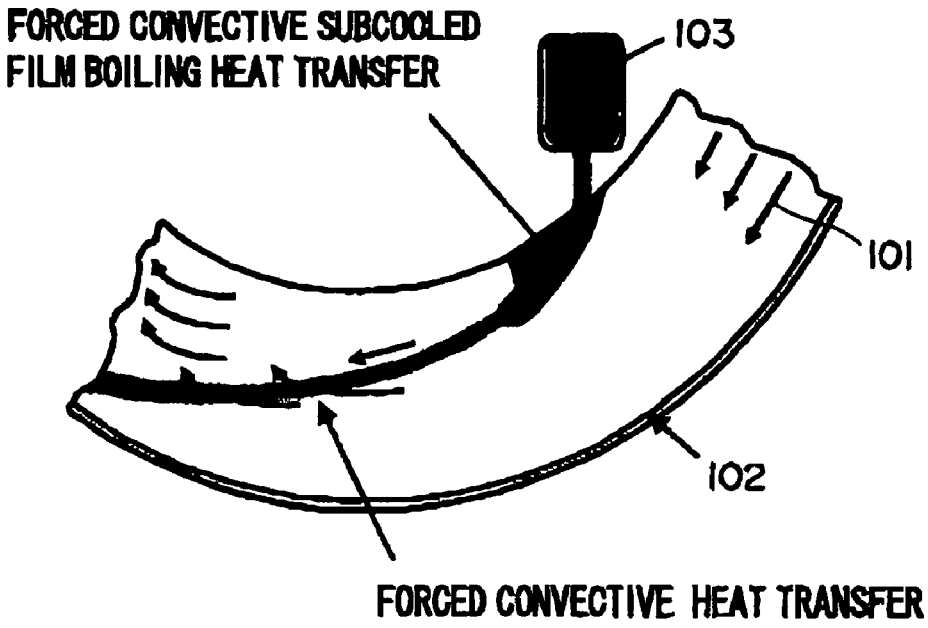
FIG. 14 is a conceptual view showing the cooling process of conventional centrifugation method.

FIG. 13 shows a result of the experimental cooling rate which can be attained by the method and the apparatus. Incidentally, in the drawing, the proposed method is compared with the gas atomizing method as a general cooling mode and with the SWAP method which currently has the maximum cooling rate as it utilizes convection cooling.

Experimental conditions:

Molten metal: Al89-Si11

Coolant: aqueous solution containing 20 wt % of calcium chloride

Molten metal temperature: 1500° C.

Coolant temperature: 20° C.

Mixing system: system which injects the molten metal into the aqueous solution pool in a beaded manner Molten metal droplet diameter: 8 mm Cooling rate estimation method: dendrite arm spacing The experimental result of FIG. 13 shows that a cooling rate which is higher than that of the SWAP method which conventionally has the maximum cooling rate by a single digit or more can be obtained by the method according to the present invention, and suggests that a metal which cannot be turned into an amorphous metal by the prior art method can be formed into the amorphous metal using the developed method.

According to the above-described amorphous metal producing method and apparatus, the cooling rate can be greatly increased as compared with that of the conventional method by cooling the molten metal 1 by using transfer of heat of boiling due to spontaneous nucleation. Therefore, since the cooling rate required for forming the amorphous metal is high, a metal which cannot be transformed into an amorphous metal in the prior art can be formed using the developed method. Moreover, since the cooling rate required for forming the amorphous metal is high, with respect to a material to which an additive which suppresses generation of the crystal nucleus for forming the amorphous metal must be added, the quantity of such an additive can be reduced or the amorphous metal can be well formed even without such an additive. Usually, it is often the case that this additive material is an expensive rare earth. However, it is possible to suppress the use of the expensive rare earth, which greatly contributes to the reduction in the manufacturing cost. In addition, if the molten metal 1 is aluminium alloy, the density of when the amorphous metal is formed can be minimized by reducing the amount of the additive.

Additionally, since the amorphous metal to be produced can be obtained as fine particles of sub-micron to 100 $\mu$m order, an amorphous bulk material can be obtained by mechanical alloying, extrusion or powder pressure welding. For example, an iron core of a transformer can be produced by using the amorphous metal. It has been conventionally known that the no-load loss can be considerably reduced and the energy saving effect can be improved by making the iron core of a transformer using amorphous metal. However, in order to use the amorphous metal for the iron core of a transformer, an amorphous thin plate having a plate thickness of 50 to 100 $\mu$m and a plate width of not less than 150 mm is required, and the development of a production technique which ensures large scale homogeneous production is demanded. In the prior art, the above-described amorphous thin plate is manufactured and used for the iron core of a transformer by attaching very thin tape-like amorphous metal plates manufactured by the melt quenching method to each other. Therefore, the manufacturing cost of the iron core is very high. However, by generating the amorphous metal in the form of fine particles according to the present invention and manufacturing the thin plate based on powder molding by using this metal as a raw material, the amorphous thin plate can be inexpensively manufactured, thereby reducing the manufacturing cost of a transformer.

Furthermore, by heating the thus obtained amorphous bulk material to the vicinity of the fusion point and crystallizing it, a polycrystal (nano-crystal material) with high strength can be obtained since the crystal particle diameter is small.

Incidentally, although the above-described mode is an example of the preferred scenario according to the present invention, the invention is not restricted thereto, and various kinds of modifications can be carried out without deviating from the scope of the invention. For example, in the above description, inert gas atmosphere is used in the casing 15 as the oxidation inhibiting means 14. However, instead of using the inert gas atmosphere, a reduced gas atmosphere such as hydrogen or carbon monoxide may be used, or the pressure in the casing 15 may be reduced to obtain the vacuum state with the low oxygen density. Incidentally, boiling due to spontaneous-bubble nucleation can be intensified while maintaining the small scale by reducing the pressure in the casing 15, and formation of fine particles of the metal droplets 1 can be further facilitated. Furthermore, the entire apparatus may be set in the inert gas atmosphere or the reduced gas atmosphere, or it may be set in the casing in which the pressure is reduced.

Moreover, the external force may be previously applied to the molten metal 1 to form fine particles, and then they may be supplied into the coolant 4. For example, by providing means for forming fine particles of the molten metal 1 between the material supplying means 3 and the coolant 4, the grains of the molten metal 1 can be ground to some extent and then supplied into the coolant 4. In this case, since the molten metal 1 is ground to some extent by the fine particle forming means and then supplied into the coolant, the specific surface area is increased, and generation of the vapor film and cooling become more efficient. Thereafter, boiling due to spontaneous-bubble nucleation is generated in the coolant 4, and the pressure wave produced by this boiling can be utilized to further facilitate formation of fine particles of the molten metal 1. Also, the cooling rate can be further improved. As the fine particle forming means for forming fine particles of the molten metal 1, application of the ultrasonic irradiation technique which has been already established as the fragmentation technique is preferable, for example. As shown in FIG. 5, an ultrasonic irradiation apparatus 16 may be set between the material supplying means 3 and the coolant 4, and the ultrasonic wave of approximately 10 kHz to 10 MHz may be emitted irradiated to the molten metal 1 dropped from the material supplying means 3. Furthermore, an electric field can be formed in the space through which the molten metal 1 passes, and an apparatus which forms fine particles of the molten metal 1 can be used. Incidentally, it can be considered that the formation of fine particles of the molten metal 1 is appropriately carried out immediately after discharging the molten metal 1 from the material supplying means 3.

Furthermore, although the molten metal 1 is supplied to the mixing nozzle 2 by dropping the molten metal 1 from the hot water outlet 7*a* of the crucible 7 in the above description, the molten metal 1 may be jetted from the hot water outlet 7*a*. In this case, the molten metal 1 must be jetted in the filate form and its quantity must be small.

Moreover, although the description has been mainly given as to the vapor film collapse based on the spontaneous collapse caused through condensation, the vapor film may collapse due to an external factor in some cases. For example, the ultrasonic irradiation apparatus which its irradiates the ultrasonic wave of approximately 10 kHz to 10 MHz to the mixing nozzle 2 constituting the cooling section or the flow of the coolant can be set, the vapor film which covers the circumference of the droplet of the molten metal in the coolant can collapse in the early stage, and the droplets of the molten metal and the coolant can be directly brought into contact with each other in the high-temperature state, thereby causing efficient boiling due to spontaneous-bubble nucleation. It is preferable to form an amorphous metal from a metal having a high fusion point. In this case, since the vapor film collapses from any direction, it may not collapse in any other area, e.g., on the opposite side, or spontaneous-bubble nucleation may not be efficiently generated even if the vapor film collapses. Therefore, it is desirable to make arrangements so as to collapse the vapor film from multiple directions in order to prevent a situation that fine particles of all of the molten metal cannot be formed leaving a residual lump of the material.

What is claimed:

1. A method for producing an amorphous metal which comprises: supplying a molten metal into a liquid coolant; forming a vapor film which covers said molten metal in said coolant; collapsing the vapor film; directly bringing said molten metal into contact with said coolant; causing boiling due to spontaneous-bubble nucleation; rapidly cooling and tearing said molten metal for fragmentation into an amorphous metal while forming fine particles thereof by utilizing a pressure wave being generated by said boiling; and obtaining said amorphous metal fine particles.

2. A method for producing an amorphous metal according to claim 1, wherein said molten metal remains molten at a temperature which causes an interface temperature with said coolant to become not less than a spontaneous-bubble nucleation temperature when directly brought into contact with said coolant and which is not more than a film boiling lower limit temperature and the molten metal is supplied into said coolant, a stable vapor film which covers said molten metal in said coolant is formed, and it is collapsed by condensation.

3. A method for producing an amorphous metal according to claim 1, wherein said molten metal is supplied into said coolant by dropping said molten metal.

4. A method for producing an amorphous metal according to claim 1, wherein said molten metal is supplied into said coolant in an atomized form.

5. A method for producing an amorphous metal according to claim 1, wherein salt is added into said coolant.

6. A method for producing an amorphous metal according to claim 1, wherein said molten metal and said coolant are supplied in the same direction with a small difference in the flow rate, and mixed.

7. A method for producing an amorphous metal according to claim 6, wherein the flow of said coolant having an area in which said coolant falls in a vertical direction is formed, and said molten metal is supplied into said fall area of vertical flow of said coolant by free fall.

8. A method for producing an amorphous metal according to claim 1, wherein an ultrasonic wave is irradiated to said molten metal before said molten metal is brought into contact with said coolant.

9. A method for producing an amorphous metal according to claim 1, wherein said molten metal is supplied into said coolant while preventing oxidation thereof.

10. A method for producing an amorphous metal according to claim 1, wherein a difference in the flow rate between said coolant and said molten metal in said coolant is not more than 1 m/s.

11. A method for producing an amorphous metal according to claim 1, wherein the vapor film which covers said molten metal is collapsed by ultrasonic irradiation.

12. A method for producing amorphous metal according to claim 1 further comprising the steps of melting the amorphous metal fine particles and repeating the steps of claim 1.

13. Apparatus for producing an amorphous metal comprising: material supplying means for supplying a molten metal while controlling the supply quantity thereof; a cooling section bringing in a coolant, the quantity of said coolant being small and sufficient for cooling and solidifying said molten metal, said cooling section mixing said coolant with a small quantity of said molten metal being supplied from said material supplying means, forming a vapor film which covers said molten metal, collapsing said vapor film, directly bringing said molten metal into contact with said coolant, and causing boiling due to spontaneous-bubble nucleation, and rapidly cooling said molten metal to be fragmented into an amorphous metal while forming fine particles thereof by utilizing a pressure wave being generated by said boiling to obtain fine particles of said amorphous metal; and recovery means for recovering said amorphous metal fine particles from said coolant.

14. Apparatus for producing an amorphous metal according to claim 13, wherein said material supplying means comprises a crucible having a stopper.

15. Apparatus for producing an amorphous metal according to claim 13, further comprising a means for adding salt added into said coolant.

16. Apparatus for producing an amorphous metal according to claim 13, wherein said cooling section is configured to form a flow of said coolant having an area in which said coolant falls into free space in a vertical direction and to supply said molten metal into said fall area of said flow of said coolant by free fall.

17. Apparatus for producing an amorphous metal according to claim 13, wherein ultrasonic irradiating means for irradiating an ultrasonic wave to said molten metal is provided between said material supplying means and said coolant in said cooling section.

18. Apparatus for producing an amorphous metal according to claim 13, wherein oxidation inhibiting means is provided for inhibiting oxidation of said molten metal supplied from said material supplying means to said cooling section.

19. Apparatus for producing an amorphous metal according to claim 13, wherein a quantity of said coolant staying in said cooling section is such that large-scale vapor explosion cannot be generated even if control in said material supplying means is lost and said molten metal is supplied at a time.

20. Apparatus for producing an amorphous metal according to claim 13, further comprising a means for collapsing the vapor film which covers said molten metal by ultrasonic irradiation.

* * * * *

UNITED STATES PATENT AND TRADEMARK OFFICE

CERTIFICATE OF CORRECTION

PATENT NO. : 7,008,463 B2
DATED : March 7, 2006
INVENTOR(S) : Masahiro Furuya

It is certified that error appears in the above-identified patent and that said Letters Patent is hereby corrected as shown below:

Title page,
Item [22], PCT Filed, should read -- Apr. 23, 2001 --.

Signed and Sealed this

Twenty-third Day of May, 2006

JON W. DUDAS
*Director of the United States Patent and Trademark Office*